US010847033B2

(12) United States Patent
Stahl

(10) Patent No.: US 10,847,033 B2
(45) Date of Patent: Nov. 24, 2020

(54) METHOD AND OBSTACLE ASSISTANCE DEVICE FOR AUTOMATICALLY ACTIVATING AN OBSTACLE DETECTION DEVICE OF A MOTOR VEHICLE

(71) Applicant: Bayerische Motoren Werke Aktiengesellschaft, Munich (DE)

(72) Inventor: Hans-Ulrich Stahl, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 42 days.

(21) Appl. No.: 16/217,232

(22) Filed: Dec. 12, 2018

(65) Prior Publication Data

US 2019/0114919 A1 Apr. 18, 2019

Related U.S. Application Data

(63) Continuation of application No. PCT/EP2017/069780, filed on Aug. 4, 2017.

(30) Foreign Application Priority Data

Aug. 31, 2016 (DE) ..... 10 2016 216 465

(51) Int. Cl.
*G08G 1/16* (2006.01)

(52) U.S. Cl.
CPC ..... *G08G 1/165* (2013.01); *G08G 1/167* (2013.01); *G08G 1/168* (2013.01)

(58) Field of Classification Search
CPC ..... G08G 1/165; G08G 1/167
See application file for complete search history.

(56) References Cited

U.S. PATENT DOCUMENTS

2008/0195284 A1 8/2008 Hammadou
2014/0309813 A1* 10/2014 Ricci ..... G06F 16/583 701/2

(Continued)

FOREIGN PATENT DOCUMENTS

DE 44 25 419 C1 12/1995
DE 10 2005 058 144 A1 6/2007

(Continued)

OTHER PUBLICATIONS

International Search Report (PCT/ISA/210) issued in PCT Application No. PCT/EP2017/069780 dated Dec. 11, 2017 with English translation (four (4) pages).

(Continued)

*Primary Examiner* — Brian A Zimmerman
*Assistant Examiner* — Kevin Lau
(74) *Attorney, Agent, or Firm* — Crowell & Moring LLP

(57) ABSTRACT

A method and an obstacle assistance device for automatically activating an obstacle detection device of a motor vehicle detects whether a visual obstacle is located in front of the motor vehicle in the driving direction, detects whether the visual obstacle is movable or is moving; detects whether a blind spot region in front of the motor vehicle in the driving direction can be released by moving the visual obstacle, and automatically activates an obstacle detection device if it has been detected that a visual obstacle is located in front of the motor vehicle in the driving direction, that the visual obstacle is movable or is moving, and that a blind spot region in front of the motor vehicle in the driving direction can be removed by moving the visual obstacle.

20 Claims, 2 Drawing Sheets

(56) References Cited

U.S. PATENT DOCUMENTS

| | | | | |
|---|---|---|---|---|
| 2015/0138358 | A1* | 5/2015 | Seo | G01S 7/52023 348/148 |
| 2015/0302737 | A1* | 10/2015 | Geerlings | G08C 17/02 340/5.25 |
| 2016/0253575 | A1* | 9/2016 | Kakegawa | G08G 1/165 701/70 |

FOREIGN PATENT DOCUMENTS

| | | | |
|---|---|---|---|
| DE | 10 2006 032 171 | A1 | 1/2008 |
| DE | 10 2006 058 213 | A1 | 7/2008 |
| DE | 10 2010 056 064 | A1 | 6/2012 |
| EP | 1 970 730 | A2 | 9/2008 |

OTHER PUBLICATIONS

German-language Written Opinion (PCT/ISA/237) issued in PCT Application No. PCT/EP2017/069780 dated Dec. 11, 2017 (five (5) pages).

German-language Search Report issued in counterpart German Application No. 102016216465.1 dated Mar. 22, 2017 with partial English translation (10 pages).

* cited by examiner

METHOD AND OBSTACLE ASSISTANCE DEVICE FOR AUTOMATICALLY ACTIVATING AN OBSTACLE DETECTION DEVICE OF A MOTOR VEHICLE

CROSS REFERENCE TO RELATED APPLICATIONS

This application is a continuation of PCT International Application No. PCT/EP2017/069780, filed Aug. 4, 2017, which claims priority under 35 U.S.C. § 119 from German Patent Application No. 10 2016 216 465.1, filed Aug. 31, 2016, the entire disclosures of which are herein expressly incorporated by reference.

BACKGROUND AND SUMMARY OF THE INVENTION

The invention relates to a method and an obstacle assistance device for automatically activating an obstacle detection device of a motor vehicle.

Obstacle detection devices for motor vehicles, using which a driver of a motor vehicle is warned about obstacles in the surroundings of the motor vehicle, are known. Typically, obstacle detection devices are automatically activated when the reverse gear of the motor vehicle is engaged (see, for example, US 2008/0195284 A1).

A distance warning system is described in DE 10 2006 058 213 A1, which is automatically activated as soon the vehicle velocity is within a predefined velocity range.

DE 10 2006 032 171 A1 discloses a distance warning system, which is automatically activated as soon as exceeding a predefined steering angle below a predefined vehicle velocity is detected.

EP 1970730 A2 discloses a surroundings monitoring device, wherein the surroundings monitoring device is automatically activated when a movement of the vehicle is determined.

A parking aid is disclosed in DE 44 25 419 C1, in which a monitoring unit for the front space is activated at low travel velocity in the forward direction.

However, using the already known monitoring and warning systems, situations occur in which the system is not activated and thus an obstacle is not detected, on the one hand, and situations occur in which the system is unnecessarily or even incorrectly activated and the driver is thus distracted in his attentiveness, on the other hand.

The invention is based on the object of providing a method and an obstacle assistance device for automatically activating an obstacle detection device of a motor vehicle, whereby the operating comfort and the operational reliability of the motor vehicle are improved.

The method according to the invention is used for automatically activating an obstacle detection device of a motor vehicle, wherein the obstacle detection device is automatically activated if it is registered that a visual obstacle is located in front of the motor vehicle in the travel direction, the visual obstacle is movable or is moving, and a blind spot region in front of the motor vehicle in the travel direction can be released by moving the visual obstacle.

An obstacle detection device in the meaning of the present application can be any driver assistance system which is capable of detecting obstacles. In addition, the obstacle detection device can display obstacles and possibly warn about them.

A visual obstacle in the meaning of this application is an object which is capable of concealing the field of vision of the driver of a motor vehicle. Such objects include, for example, a door, for example, a garage, barn, or underground garage door; a barrier having a protective cover hanging down; or a pedestrian who carries a large object, wherein the object has a large vertical extent.

In the meaning of the present application, the term "in front of the motor vehicle in the travel direction" means a space which extends from the front region of the motor vehicle in the direction of the travel direction. This means that during forward travel, the front region is arranged in the front section of the motor vehicle and during reverse travel, the front region is arranged in the rear section of the motor vehicle. The space defined by the term "in front of the motor vehicle in the travel direction" extends not only over the width of the motor vehicle, but rather also laterally beyond it, in particular to consider the vehicle trajectories possible by way of the steering angle. For motor vehicles which can move laterally, for example, by way of a special parking device, "in front of the motor vehicle in the travel direction" correspondingly means the space laterally of the vehicle.

A blind spot region is understood in the meaning of the present application as a region in front of the motor vehicle in the travel direction which is not visible to the driver of the motor vehicle because it is concealed, on the one hand, by the visual obstacle and, on the other hand, by the vehicle parts which are arranged in front of the driver in the travel direction. Upon removal or movement of the visual obstacle, the blind spot region is released, i.e., the blind spot region is then no longer concealed by the visual obstacle. However, the blind spot region cannot be seen by the driver, because the vehicle parts which are arranged in front of the driver in the travel direction shield the free view of the driver of the blind spot region. A blind spot region arises, for example, in a situation in which a vehicle remains stationary in front of a door in order to wait for it to open. After the door has opened, the view of the space located behind it is released in principle, however, a region remains in the released space which the driver cannot see from the vehicle, because vehicle parts, for example, the engine hood, block the free view of the ground or region close to the ground from the front region of the motor vehicle, and in particular from the visual obstacle, in the direction of the released space.

According to the method according to the invention and the obstacle assistance device according to the invention for automatically activating an obstacle detection device, it is registered whether a visual obstacle is located in front of the motor vehicle in the travel direction, whether the visual obstacle is movable or is moving, and whether a blind spot region in front of the motor vehicle in the travel direction can be released by moving the visual obstacle. The obstacle detection device is automatically activated if it is registered that a visual obstacle is located in front of the motor vehicle in the travel direction, the visual obstacle is movable or is moving, and a blind spot region in front of the motor vehicle in the travel direction can be released by moving the visual obstacle.

The term "can be released" means both the possibility of a release and also the actual release of a blind spot region in front of the motor vehicle in the travel direction by moving the visual obstacle.

In other words, an obstacle detection device is only activated if a blind spot region can be released by moving the visual obstacle. The obstacle detection device is therefore only activated in specific situations, in which an increased risk potential prevails, to thus offer enhanced safety and enhanced operating comfort to the driver.

According to one preferred embodiment, to register whether a visual obstacle is located in front of the motor vehicle in the travel direction and/or to register whether the visual obstacle is movable or is moving and/or to register whether a blind spot region in front of the motor vehicle in the travel direction can be released by moving the visual obstacle, a registration apparatus is used, which has at least one of the following: ultrasonic sensor system, lidar sensor system, radar sensor system, and camera system. Examples of sensor systems or camera systems are: a surroundings camera system, which registers the surrounding region (for example, front and/or rear and/or lateral) of the motor vehicle, a camera system, which is additionally used to read out speed limit signs, a sensor for automatic high beams, a surroundings camera system, which is additionally used to detect or display a parking situation, a parking sensor, which detects distances to obstacles during a parking situation.

According to a further preferred embodiment, it is registered whether a visual obstacle is located in front of the motor vehicle in the travel direction and/or whether the visual obstacle is movable or is moving and/or whether a blind spot region in front of the motor vehicle in the travel direction can be released by moving the visual obstacle by analyzing image data, which are received from a camera system of the registration apparatus. The image data are advantageously received from a camera of the camera system which is attached in or on the motor vehicle such that it registers the blind spot region in front of the motor vehicle in the travel direction. The analysis of the image data can be performed in this case via a control unit, which is designed either as a separate unit or as part of the obstacle detection device. The camera is advantageously attached in or on the motor vehicle so that its viewing angle extends as close as possible to the front or rear region, respectively, of the motor vehicle. The camera is preferably attached in or on the motor vehicle at a height which is located higher than the eye height of a driver, to achieve a smaller blind spot region for the camera in comparison to the driver. One example of such a camera of the camera system is a camera for reading out speed limit signs.

According to a further preferred embodiment, it is registered whether a visual obstacle is located in front of the motor vehicle in the travel direction and/or whether the visual obstacle is movable or is moving and/or whether a blind spot region in front of the motor vehicle in the travel direction can be released by moving the visual obstacle by analyzing a time curve of distance data in relation to obstacles located in the surroundings of the motor vehicle, which are received and analyzed by the registration apparatus. Distance data are to be understood in this case as data which indicate the distance to obstacles located in the surroundings of the motor vehicle. Such distance data are registered, for example, via the above-mentioned sensor systems. For the analysis, the distance data are received over a predetermined duration from the registration apparatus. The distance data are preferably analyzed by way of a control unit, which can be designed as a separate unit or as part of the obstacle detection device. The analysis is carried out to obtain inferences about the shape, the location, and/or the movement of an obstacle and possibly to classify the obstacle using this information into the category "visual obstacle", "moving visual obstacle", and/or "visual obstacle releasing blind spot region". Elements of the registration apparatus, i.e., for example, multiple sensors, are advantageously attached at different positions on or in the motor vehicle for this purpose.

A triangulation method is advantageously used for the analysis. In one preferred embodiment, at least two sensors and/or cameras of the above-described registration apparatus are attached on and/or in the motor vehicle at different positions. By way of the triangulation method using multiple different sensors and/or cameras, the accurate position of a visual obstacle, the change of this position within a predetermined duration, and the capability of the visual obstacle of releasing a blind spot region can be determined during the analysis. The image data of two different vehicle cameras are advantageously analyzed to obtain inferences about shape and/or movement of a visual obstacle. Data on the curve of the vehicle velocity can also be incorporated into the analysis for assistance.

Using the above-described examples of the registration, it is possible to determine whether a visual obstacle is located in front of the motor vehicle in the travel direction; in addition, it can be registered using the mentioned examples whether the visual obstacle is movable or is moving and whether a blind spot region in front of the motor vehicle in the travel direction can be released or is released by the movement. It is differentiated by the described procedure of the registration whether the visual obstacle is a non-movable or non-moving visual obstacle, for example, a concrete wall, or a visual obstacle which does not result in a release of a blind spot region, for example, a conventional barrier. Therefore, on the one hand, the operational reliability is enhanced by automatically activating the obstacle detection device and, on the other hand, the operating comfort is enhanced, because the obstacle detection device is not activated unnecessarily or undesirably and the driver is thus not distracted.

According to a further preferred embodiment, the registration as to whether a visual obstacle is located in front of the motor vehicle in the travel direction and/or whether the visual obstacle is movable or is moving and/or whether a blind spot region in front of the motor vehicle in the travel direction can be released by moving the visual obstacle is performed by analysis of at least one of the following: data of a GPS system and/or a mobile wireless system and/or a navigation system and/or a server and/or other vehicles. For example, for this purpose, present location data of the motor vehicle can be compared to location determination data, which is stored for the respective visual obstacle, for example, a door, of a GPS system and/or a mobile wireless system and/or a navigation system, in order to establish whether it is a visual obstacle which is movable and can release a blind spot region. It is also possible to detect that the motor vehicle leaves a mapped street via data of a GPS system and/or a mobile wireless system and/or a navigation system. Furthermore, signals which are generated as a result of an actuation of a window regulator can be used for the analysis. For example, the actuation of the driver's window is used as an indication for an interaction of the driver with a movement mechanism (for example, door opener) of the visual obstacle. Moreover, signals which are received in dependence on the surroundings situation of the motor vehicle are possible for the analysis. The following signals can specify the surroundings situation and/or its change: change of the lighting situation, which is equivalent to an entry into a garage; change of the precipitation, which indicates the entry into an underground garage, for example; loss or damping of electromagnetic signals, for example, from a satellite, a radio transmitter, or a telecommunication unit, which in turn reflects a surroundings situation in an underground garage; it can be recognized by the mentioned signals that the motor vehicle is approaching a building (for example, garage) and/or is located therein. Furthermore, signals of an electronic unit, which is designed to control an opening and closing mechanism of a door, can be used for the analysis. The radio waves generated by a radio remote control are contemplated, for example, which permit inferences about the specific situation that a movable visual obstacle is located in front of the vehicle, by the movement of which a blind spot region can be released. Furthermore, the specific situation can be learned manually in a first step. In a later step, present travel data and motor vehicle data can be compared to recorded data from preceding trips and associated with the specific situation. The exchange of learned situations and/or locations linked to these situations between different vehicles is possible via a server and/or telecommunication (car-to-car).

According to a further preferred embodiment, the obstacle detection device has a sensor device, which detects obstacles in the surroundings of the motor vehicle upon activation of the obstacle detection device. Advantageously, the sensor device optionally has at least one of the following to detect obstacles in the surroundings of the motor vehicle: ultrasonic sensor system, lidar sensor system, radar sensor system, and camera system. The camera system preferably has a camera for the front section and/or flank section and/or rear section, for example, a reversing camera.

According to a further preferred embodiment, the sensor device has a camera system having a camera which is attached in or on the motor vehicle such that it registers obstacles in the blind spot region in front of the motor vehicle in the travel direction. Upon activation of the obstacle detection device, this camera detects obstacles in the blind spot region in front of the motor vehicle in the travel direction. This camera can be identical, for example, to the above-described camera of the registration apparatus.

An activated obstacle detection device in the meaning of the present application is to be understood as an obstacle detection device in which the sensor device is activated, so that obstacles located in the surroundings of the motor vehicle, in particular obstacles located in front of the motor vehicle in the travel direction, are detected. The sensor device is automatically activated by the control unit if it is registered that a visual obstacle is located in front of the motor vehicle in the travel direction, the visual obstacle is movable or is moving, and a blind spot region in front of the motor vehicle in the travel direction can be released by moving the visual obstacle.

In one advantageous embodiment, the sensor device is identical to the registration apparatus.

According to one preferred embodiment, the obstacle detection device has a display device. The display device displays the obstacles detected by the sensor device upon activation of the obstacle detection device. The display device can be designed as an optical apparatus and/or as an acoustic apparatus and/or as a haptic apparatus. The display device is designed for the purpose of displaying items of information on obstacles which are located in the surroundings of the motor vehicle to the occupants of the motor vehicle. For example, the display device displays distances to obstacles as a schematic illustration, wherein colored bars in different colors are displayed on a display screen of the motor vehicle depending on the location and distance of a detected obstacle and in addition an acoustic display is provided upon falling below a specific distance.

According to a further preferred embodiment, a warning device is activated upon activation of the obstacle detection device. The warning device is advantageously coupled to the control unit. The control unit is designed to activate the warning device if it is registered that a visual obstacle is located in front of the motor vehicle in the travel direction, the visual obstacle is movable or is moving, and a blind spot region in front of the motor vehicle in the travel direction can be released by moving the visual obstacle. Upon activation of the obstacle detection device, the warning device executes at least one of the following actions if an obstacle is detected in the blind spot region in front of the motor vehicle in the travel direction by the sensor device: optically displaying the obstacles detected by the sensor device on a display element of the motor vehicle. For this purpose, the image recorded by a camera, which is attached in or on the motor vehicle and which registers obstacles in the blind spot region in front of the motor vehicle in the travel direction, is advantageously displayed on an optical display element, for example, a display screen, of the motor vehicle. A further action is emitting an optical, haptic, and/or acoustic warning signal. This warning signal advantageously differs from the signal emitted by the display device. This has the result that the driver is warned of a hazard and can take precautions to avoid risk. Thus, for example, the display device can emit tones which become higher as the distance to the detected obstacle decreases, while the warning signal of the warning device is a deeper sustained tone. A further action is controlling an electronic brake controller of the motor vehicle. For this purpose, an intervention is made via the control unit in the electronic brake controller of the motor vehicle. Possible consequences of such an intervention are the automatic braking of the motor vehicle and/or the prevention of the motor vehicle from driving off. The operational safety of the motor vehicle is thus substantially enhanced. A potentially hazardous situation, for example, a child playing in the blind spot region, can therefore be avoided without the driver having to actively intervene in the procedure.

According to one preferred embodiment, the obstacle detection device is activated if it is registered that a visual obstacle is located in front of the motor vehicle in the travel direction, the visual obstacle is movable or is moving orthogonally to the travel direction, and a blind spot region in front of the motor vehicle in the travel direction can be released by moving the visual obstacle. A visual obstacle movable or moving orthogonally to the travel direction is understood in the meaning of the present application as essentially orthogonal to the travel direction, i.e., a direction which is substantially at a right angle to the travel direction is also included. Furthermore, the direction which is perceptible as orthogonal by the driver of the motor vehicle falls under the term. This thus means that an inclined movement of the visual obstacle which is perceptible as orthogonal from the viewpoint of the driver is also included in the term. From the viewpoint of a driver of the motor vehicle, who looks in the travel direction, a movement extending "orthogonally to the travel direction" means a vertically or horizontally extending movement, i.e., for example, from left to right or from right to left or from top to bottom or from bottom to top.

The invention furthermore relates to an obstacle assistance device for automatically activating an obstacle detection device, which comprises: an obstacle detection device, which is designed to detect obstacles in the surroundings of a motor vehicle; a registration apparatus, which is designed to register whether a visual obstacle is located in front of the motor vehicle in the travel direction, whether the visual obstacle is movable or is moving, and whether a blind spot region in front of the motor vehicle in the travel direction can be released by moving the visual obstacle; and a control unit coupled to the registration apparatus, wherein the control unit is designed to automatically activate the obstacle detection device if it is registered that a visual obstacle is located in front of the motor vehicle in the travel direction, the visual obstacle is movable or is moving, and a blind spot region in front of the motor vehicle in the travel direction can be released by moving the visual obstacle.

According to one preferred embodiment, the visual obstacle comprises a door.

According to one preferred embodiment, the registration apparatus has at least one of the following to register whether a visual obstacle is located in front of the motor vehicle in the travel direction and/or whether the visual obstacle is movable or is moving and/or whether a blind spot region in front of the motor vehicle in the travel direction can be released by moving the visual obstacle: ultrasonic sensor system, lidar sensor system, radar sensor system, and camera system.

According to one preferred embodiment, the registration apparatus is designed to execute at least one of the following processes to register whether a visual obstacle is located in front of the motor vehicle in the travel direction and/or whether the visual obstacle is movable or is moving and/or whether a blind spot region in front of the motor vehicle in the travel direction can be released by moving the visual obstacle: analyzing image data which are received from a camera system of the registration apparatus; the camera system advantageously has a camera which is attached in or on the motor vehicle such that it registers the blind spot region in front of the motor vehicle in the travel direction; analyzing a time curve of distance data in relation to obstacles located in the surroundings of the motor vehicle, which are received and analyzed by the registration apparatus; analyzing data of a GPS system and/or a mobile wireless system and/or a navigation system and/or a server and/or other vehicles; analyzing signals which are generated as a result of an actuation of a window regulator; analyzing signals which are received in dependence on the surroundings situation of the motor vehicle; analyzing signals of an electronic unit which is designed to control an opening and closing mechanism of a door.

According to one preferred embodiment, the obstacle assistance device has a sensor device, which is designed to detect obstacles in the surroundings of the motor vehicle upon activation of the obstacle detection device. The sensor device advantageously has at least one of the following to detect obstacles in the surroundings of the motor vehicle: ultrasonic sensor system, lidar sensor system, radar sensor system, and camera system.

According to one preferred embodiment, the sensor device has a camera system having a camera which is attached in or on the motor vehicle such that it registers obstacles in the blind spot region in front of the motor vehicle in the travel direction and which is designed to detect obstacles in the blind spot region in front of the motor vehicle in the travel direction upon activation of the obstacle detection device.

According to one preferred embodiment, the obstacle detection device has a display device. The display device is designed to display the obstacles detected by the sensor device upon activation of the obstacle detection device.

According to one preferred embodiment, the obstacle assistance device has a warning device coupled to the control unit. The control unit is designed to activate the warning device upon activation of the obstacle detection device. The warning device is designed to execute at least one of the following actions if an obstacle is detected in the blind spot region in front of the motor vehicle in the travel direction by the sensor device: optically displaying the obstacles detected by the sensor device on a display element of the motor vehicle; emitting an optical, haptic, and/or acoustic warning signal; controlling an electronic brake controller of the motor vehicle.

According to one preferred embodiment, the registration apparatus is designed to register whether a visual obstacle is located in front of the motor vehicle in the travel direction, whether the visual obstacle is movable or is moving orthogonally to the travel direction, and whether a blind spot region in front of the motor vehicle in the travel direction can be released by moving the visual obstacle. The control unit is designed to automatically activate the obstacle detection device if it is registered that a visual obstacle is located in front of the motor vehicle in the travel direction, the visual obstacle is movable or is moving orthogonally to the travel direction, and a blind spot region in front of the motor vehicle in the travel direction can be released by moving the visual obstacle.

Alternatively or additionally, all further devices which have already been described in the above explanation of the method according to the invention are also conceivable as components of the obstacle assistance device for automatically activating an obstacle detection device.

As described above, the components of the obstacle assistance device and the warning device can have integrated control units and/or can be coupled to the control unit of the obstacle assistance device. The coupling of the respective control unit to the respective device and/or to another control unit takes place via a data bus.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
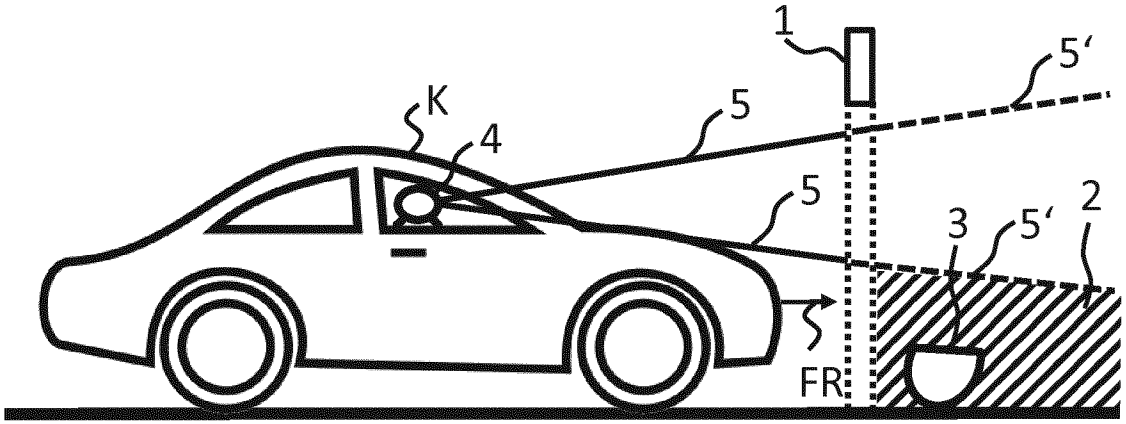
FIG. 1 is a schematic illustration of a motor vehicle in the vicinity of a visual obstacle.

FIG. 1 shows a motor vehicle K having a driver 4. The motor vehicle K stands in front of or moves toward a garage door 1, which is arranged in front of the motor vehicle K in the travel direction FR. The field of vision of the driver is indicated by lines 5 and 5'. The lines which are identified with 5 indicate the field of vision of the driver when the garage door 1 is closed. The closed garage door is indicated with the aid of the solid and dotted lines. The lines which are identified with 5' indicate the field of vision of the driver when the garage door 1 is open. The open garage door 1 is identified by the solid lines.

The driver cannot see a region directly in front of the motor vehicle K in the travel direction FR, below the lines 5 and 5', from his position because the region is shielded by the motor vehicle K, in particular by the engine hood. This region is always present, independently of whether the garage door 1 is open or closed. During a conventional automobile trip, the nonvisible region does not play an important role, because the driver 4 normally directs his view in the travel direction FR and he has already checked the regions which become hidden in the course of the trip due to approach of the vehicle. However, if the vision of the driver is blocked by a visual obstacle, for example, the garage door 1, the above-described region thus cannot be seen beforehand.

The region which is concealed by both the garage door 1 and also by the shielding of the motor vehicle K is referred to in the scope of the present application as the blind spot region 2. When the garage door 1 is opened and the driver 4 moves the motor vehicle K in the travel direction FR into the garage, i.e., the space behind the garage door 1, the blind spot region 2 is driven through without the driver being able to check it beforehand. If an object, for example, a shopping basket 3, has been placed in the blind spot region, the motor vehicle K collides with the shopping basket 3. To prevent this situation, in the method according to the invention or the obstacle assistance device according to the invention, respectively, for automatically activating on obstacle detection device, this specific situation is registered and the obstacle detection device is activated. The nonvisible blind spot region 2 can now be checked by the activation of the obstacle detection device and a collision with the shopping basket 3 can be avoided.

Figure 2:
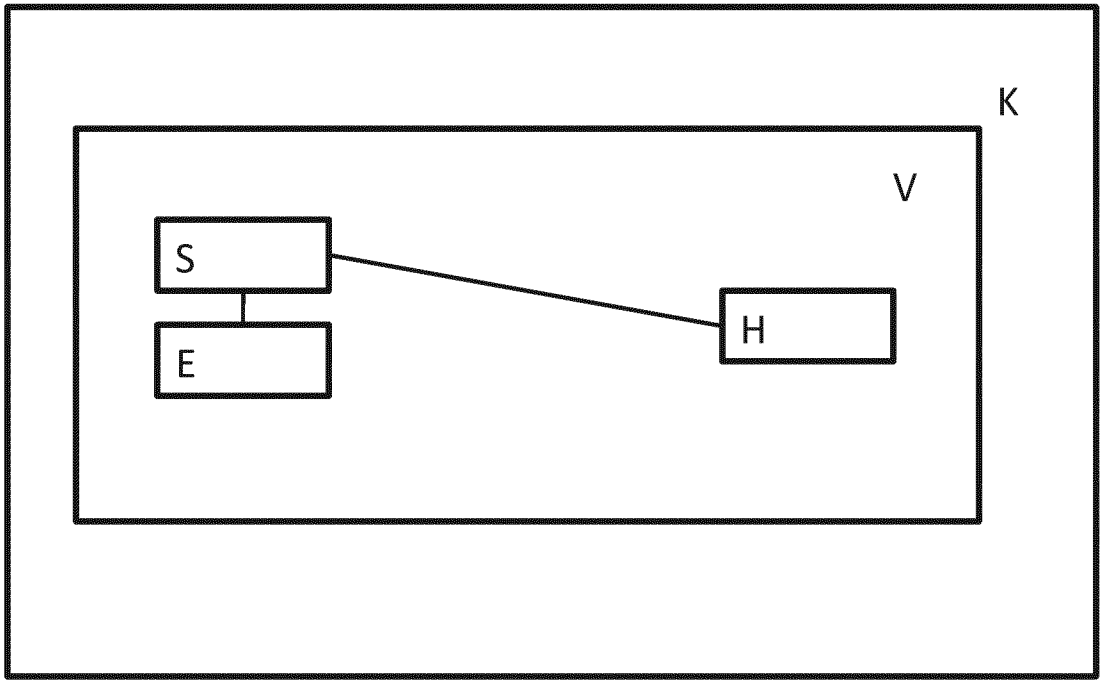
FIG. 2 is a schematic illustration of a device for automatically activating an obstacle detection device according to one embodiment.

FIG. 2 schematically shows how the components of the obstacle assistance device according to the invention are coupled. The schematically shown motor vehicle K is equipped with the obstacle assistance device V. The obstacle assistance device has an obstacle detection device H, a registration apparatus E, and a control unit S, wherein the registration apparatus E and the control unit S are coupled to one another. Furthermore, the control unit S is coupled to the obstacle detection device H.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for automatically activating an obstacle detection device of a motor vehicle, the method comprising the steps of:

registering whether a visual obstacle is located in front of the motor vehicle in the travel direction;

registering whether the visual obstacle is movable or is moving;

registering whether a blind spot region in front of the motor vehicle in the travel direction can be released by moving the visual obstacle; and automatically activating an obstacle detection device if it is registered that a visual obstacle is located in front of the motor vehicle in the travel direction, the visual obstacle is movable or is moving, and a blind spot region in front of the motor vehicle in the travel direction can be released by moving the visual obstacle.

2. The method as claimed in claim 1, wherein to register one or more of: (i) whether a visual obstacle is located in front of the motor vehicle in the travel direction, (ii) whether the visual obstacle is movable or is moving, and (iii) whether a blind spot region in front of the motor vehicle in the travel direction can be released by moving the visual obstacle, the visual obstacle comprises a door.

3. The method as claimed in claim 1, wherein to register one or more of: (i) whether a visual obstacle is located in front of the motor vehicle in the travel direction, (ii) whether the visual obstacle is movable or is moving, and (iii) whether a blind spot region in front of the motor vehicle in the travel direction can be released by moving the visual obstacle, a registration apparatus is used, which has at least one of: an ultrasonic sensor system, a lidar sensor system, a radar sensor system, and a camera system.

4. The method as claimed in claim 3, wherein image data is analyzed to register whether a visual obstacle is located in front of the motor vehicle in the travel direction, whether the visual obstacle is movable or is moving, and/or whether a blind spot region in front of the motor vehicle in the travel direction can be released by moving the visual obstacle, which image data are received from a camera system of the registration apparatus, and the image data are optionally received from a camera of the camera system which is attached in or on the motor vehicle such that it registers the blind spot region in front of the motor vehicle in the travel direction.

5. The method as claimed in claim 3, wherein a time curve of distance data in relation to obstacles located in the surroundings of the motor vehicle is analyzed to register whether a visual obstacle is located in front of the motor vehicle in the travel direction, whether the visual obstacle is movable or is moving, and/or whether a blind spot region in front of the motor vehicle in the travel direction can be released by moving the visual obstacle which data are received and analyzed by the registration apparatus.

6. The method as claimed in claim 1, wherein the registration as to whether a visual obstacle is located in front of the motor vehicle in the travel direction, whether the visual obstacle is movable or is moving, and/or whether a blind spot region in front of the motor vehicle in the travel direction can be released by moving the visual obstacle, is performed by analysis of at least one of:

data of a GPS system, a mobile wireless system, a navigation system, a server and/or from other vehicles;

signals which are generated as a result of an actuation of a window regulator;

signals which are received in dependence on the surroundings situation of the motor vehicle;

signals of an electronic unit which is designed to control an opening and closing mechanism of a door.

7. The method as claimed in claim 1, wherein the obstacle detection device has a sensor device and upon activation of the obstacle detection device, obstacles are detected in the surroundings of the motor vehicle by the sensor device, and the sensor device optionally has at least one of the following to detect obstacles in the surroundings of the motor vehicle: an ultrasonic sensor system, a lidar sensor system, a radar sensor system, and a camera system.

8. The method as claimed in claim 7, wherein the sensor device has a camera system having a camera which is attached in or on the motor vehicle such that it registers the blind spot region in front of the motor vehicle in the travel direction and wherein, upon activation of the obstacle detection device, the camera detects obstacles in the blind spot region in front of the motor vehicle in the travel direction.

9. The method as claimed in claim 7, wherein the obstacle detection device has a display device and the display device displays the obstacles detected by the sensor device upon activation of the obstacle detection device.

10. The method as claimed in claim 7, wherein a warning device is activated upon activation of the obstacle detection device and wherein the warning device executes at least one of the following actions if an obstacle is detected in the blind spot region in front of the motor vehicle in the travel direction by the sensor device:

optically displaying the obstacles detected by the sensor device on a display element of the motor vehicle;

emitting an optical, haptic, and/or acoustic warning signal; and controlling an electronic brake controller of the motor vehicle.

11. The method as claimed in claim 1, wherein the obstacle detection device is activated if it is registered that a visual obstacle is located in front of the motor vehicle in the travel direction, the visual obstacle is movable or is moving orthogonally to the travel direction, and a blind spot region in front of the motor vehicle in the travel direction can be released by moving the visual obstacle.

12. An obstacle assistance device for automatically activating an obstacle detection device, comprising:

an obstacle detection device, which is designed to detect obstacles in the surroundings of a motor vehicle;

a registration apparatus, which is designed to register whether a visual obstacle is located in front of the motor vehicle in the travel direction, whether the visual obstacle is movable or is moving, and whether a blind spot region in front of the motor vehicle in the travel direction can be released by moving the visual obstacle; and a control unit coupled to the registration apparatus, wherein the control unit is designed to automatically activate the obstacle detection device if it is registered that a visual obstacle is located in front of the motor vehicle in the travel direction, the visual obstacle is movable or is moving, and a blind spot region in front of the motor vehicle in the travel direction can be released by moving the visual obstacle.

13. The obstacle assistance device as claimed in claim 12, wherein the visual obstacle comprises a door.

14. The obstacle assistance device as claimed in claim 12, wherein the registration apparatus has at least one of the following to register whether a visual obstacle is located in front of the motor vehicle in the travel direction, whether the visual obstacle is movable or is moving, and/or whether a blind spot region in front of the motor vehicle in the travel direction can be released by moving the visual obstacle: an ultrasonic sensor system, a lidar sensor system, a radar sensor system, and a camera system.

15. The obstacle assistance device as claimed in claim 12, wherein the registration apparatus is designed to execute at least one of the following processes to register whether a visual obstacle is located in front of the motor vehicle in the travel direction, whether the visual obstacle is movable or is moving, and/or whether a blind spot region in front of the motor vehicle in the travel direction can be released by moving the visual obstacle:

analyzing image data which are received from a camera system of the registration apparatus, wherein the camera system optionally has a camera which is attached in or on the motor vehicle such that it registers the blind spot region in front of the motor vehicle in the travel direction;

analyzing a time curve of distance data in relation to obstacles located in the surroundings of the motor vehicle, which are received and analyzed by the registration apparatus;

analyzing data of a GPS system, a mobile wireless system, a navigation system, a server, and/or other vehicles;

analyzing signals which are generated as a result of an actuation of a window regulator;

analyzing signals which are received in dependence on the surroundings situation of the motor vehicle;

analyzing signals of an electronic unit which is designed to control an opening and closing mechanism of a door.

16. The obstacle assistance device as claimed in claim 12, wherein the obstacle detection device has a sensor device which is designed to detect obstacles in the surroundings of the motor vehicle upon activation of the obstacle detection device, and the sensor device optionally has at least one of the following to detect obstacles in the surroundings of the motor vehicle: an ultrasonic sensor system, a lidar sensor system, a radar sensor system, and a camera system.

17. The obstacle assistance device as claimed in claim 16, wherein the sensor device has a camera system having a camera which is attached in or on the motor vehicle such that it registers obstacles in the blind spot region in front of the motor vehicle in the travel direction and which is designed to detect obstacles in the blind spot region in front of the motor vehicle in the travel direction upon activation of the obstacle detection device.

18. The obstacle assistance device as claimed in claim 12, wherein the obstacle detection device has a display device and the display device is designed to display the obstacles detected by the sensor device upon activation of the obstacle detection device.

19. The obstacle assistance device as claimed in claim 12, wherein the obstacle assistance device has a warning device coupled to the control unit, the control unit is designed to activate the warning device upon activation of the obstacle detection device, and the warning device is designed to execute at least one of the following actions if an obstacle is detected in the blind spot region in front of the motor vehicle in the travel direction by the sensor device:

optically displaying the obstacles detected by the sensor device on a display element of the motor vehicle;

emitting an optical, haptic, and/or acoustic warning signal; and controlling an electronic brake controller of the motor vehicle.

20. The obstacle assistance device as claimed in claim 12, wherein the registration apparatus is designed to register whether a visual obstacle is located in front of the motor vehicle in the travel direction, whether the visual obstacle is movable or is moving orthogonally to the travel direction, and whether a blind spot region in front of the motor vehicle in the travel direction can be released by moving the visual obstacle, and the control unit is designed to automatically activate the obstacle detection device if it is registered that a visual obstacle is located in front of the motor vehicle in the travel direction, the visual obstacle is movable or is moving orthogonally to the travel direction, and a blind spot region in front of the motor vehicle in the travel direction can be released by moving the visual obstacle.

* * * * *